US008744301B2

(12) United States Patent
Yoneda et al.

(10) Patent No.: US 8,744,301 B2
(45) Date of Patent: Jun. 3, 2014

(54) IMAGE FORMING APPARATUS AND CLEANING CONTROL METHOD

(71) Applicant: Sharp Kabushiki Kaisha, Osaka (JP)

(72) Inventors: Iori Yoneda, Osaka (JP); Katsuya Takano, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 18 days.

(21) Appl. No.: 13/685,888

(22) Filed: Nov. 27, 2012

(65) Prior Publication Data

US 2013/0136486 A1 May 30, 2013

(30) Foreign Application Priority Data

Nov. 28, 2011 (JP) ..... 2011-258951

(51) Int. Cl.
*G03G 15/02* (2006.01)

(52) U.S. Cl.
CPC ..... *G03G 15/0225* (2013.01)
USPC ..... 399/100

(58) Field of Classification Search
CPC G03G 15/0225; G03G 15/0258; G03G 15/02
USPC ..... 399/100
See application file for complete search history.

(56) References Cited

U.S. PATENT DOCUMENTS 5,532,798 A * 7/1996 Nakagami et al. ..... 399/170

FOREIGN PATENT DOCUMENTS

| | | |
|---|---|---|
| JP | 01-312563 | 12/1989 |
| JP | 09-258528 | 10/1997 |
| JP | 2006-317879 | 11/2006 |
| JP | 2007-286364 | 11/2007 |
| JP | 2008-026739 | 2/2008 |
| JP | 2008-026739 | * 7/2008 |
| JP | 2010-160291 | 7/2010 |
| JP | 2010-256569 | 11/2010 |

* cited by examiner

*Primary Examiner* — Hoang Ngo
(74) *Attorney, Agent, or Firm* — Nixon & Vanderhye, P.C.

(57) ABSTRACT

In an image forming apparatus for forming an image by electrophotography, a charging device is comprised of a needle electrode in which a plurality of saw teeth are arrayed in one direction; a cleaning rubber roller that cleans the needle electrode; a cleaning member supporter; a moving portion that moves the cleaning member supporter; and a control portion that controls the charging device, and the control portion includes a function to increase a saw-tooth current value by increasing print cumulative count; and a function to decrease the saw-tooth current value at the time of performing cleaning.

4 Claims, 11 Drawing Sheets

IMAGE FORMING APPARATUS AND CLEANING CONTROL METHOD

This Nonprovisional application claims priority under 35 U.S.C. §119(a) on Patent Application No. 2011-258951 filed in Japan on 28 Nov. 2011, the entire contents of which are hereby incorporated by reference.

BACKGROUND OF THE INVENTION (1) Field of the Invention

The present invention relates to an image forming apparatus and a cleaning control method, and specifically to an image forming apparatus by electrophotography provided with a charging device for charging the surface of a photoreceptor to perform image formation based on an electrostatic latent image formed on the photoreceptor, and a cleaning control method.

(2) Description of the Prior Art

An image forming apparatus by electrophotography is equipped with a charging device for uniformly charging the surface of a photoreceptor. The charging device includes, for example, a noncontact type charging device that does not come into contact with the surface of the photoreceptor. The noncontact type charging device charges the surface of the photoreceptor by discharge from an electrode to which high-voltage power supply is applied, so-called corona discharge. The noncontact type charging device includes a saw-tooth type charging device having a plurality of needle electrodes.

There is a problem for the saw-tooth type charging device that a toner, silica and dust floating in an image forming apparatus provided with the charging device are adsorbed to tip portions of saw teeth in which a high-voltage electric field is generated. Additionally, leaving such a problem prevents from performing proper discharge, and a so-called discharge defect is caused. Such a discharge defect prevents the photoreceptor from being uniformly charged, thus causing an image defect, which poses a problem.

Further, corona products such as ozone and nitrogen oxide are generated with discharge by the charging device.

There is a problem that since such nitrogen oxide, ozone, and others oxidize the surface of the photoreceptor and lower electric resistance, thereby causing electrification charge on the surface of the photoreceptor to be easily leaked, defects such as image blurring, image deletion, and white spots are caused in an image formed on the photoreceptor.

Consequently, in order to solve a conventional problem described above, a related art has been proposed that tips of saw teeth are regularly cleaned with a cleaning roller, thereby removing a toner, silica, dust and the like attached to tip portions of the saw teeth (see Patent Literature 1).

Additionally, a device has been proposed for controlling so as to operate a cleaning member when a discharge member becomes dirty in consideration of a life of a cleaning member such as a cleaning roller constituting the above-described related art (see Patent Literature 2).

Note that, in an ozone generating mechanism, ozone is generated by collision of an electron and an oxygen molecule, and thus unavoidably generated in discharge in air. The quantity of electrons generated in such discharge is increased as the amount of the current which is added to saw teeth is increased. Therefore, prevention of excessive generation thereof is allowed by decreasing the amount of the saw-tooth current.

PRIOR ART LITERATURES

Patent Literature 1: Japanese Patent Application Laid-open No. 2008-26739

Patent Literature 2: Japanese Patent Application Laid-open No. 9-258528

However, there is a problem that ozone generated in corona discharge lowers resistance of the photoreceptor to cause image defects such as image blurring and white spots, thereby shortening a life of the photoreceptor. Further, there is a problem that at the end of life, unevenness of an image appears since siloxane and the like are attached to tips of saw teeth.

In order to make unevenness of an image less visible, it is necessary to increase the saw-tooth current or increase applied voltage, thus causing a large amount of ozone to be generated.

Accordingly, there has been a problem in the related art that a saw-tooth current is increased in consideration of a charge life under initial conditions, thereby causing an excessive amount of ozone to be generated.

SUMMARY OF THE INVENTION

The present invention has been devised in view of the above-described conventional problems and relates to an image forming apparatus, and an object thereof is to provide an image forming apparatus that suppresses image defects such as image blurring and white spots by preventing generation of an excessive amount of ozone to attempt stabilization of image quality, while to be able to attempt to give a charging portion for charging a photoreceptor a longer life, and a cleaning control method.

Description will be given for the image forming apparatus according to the present invention in order to solve the above-described problems as follows.

The present invention is an image forming apparatus provided with a charging portion that imparts predetermined potential to a photoreceptor on which an electrostatic latent image is formed so as the photo receptor is charged; a control portion that controls the charging portion; and an image forming portion that forms an image based on the electrostatic latent image that is formed on the photoreceptor charged by electrophotography, in which the charging portion is comprised of a needle electrode in which a plurality of saw teeth is arrayed in one direction (approximately vertical direction with respect to a moving direction of the photoreceptor); a cleaning member that cleans the needle electrode by moving along an array direction of the plurality of the saw teeth while sequentially contacting with tip portions of the plurality of the saw teeth; a cleaning member supporter that supports the cleaning member; and a moving portion that moves the cleaning member supporter along the array direction of the plurality of the saw teeth, and the control portion includes a function to increase a current value that is applied to the saw teeth (saw-tooth current) by increasing a cumulative value of the number of printed paper (for example, print cumulative count); and a function to decrease the current value that is applied to the saw teeth to a predetermined value when cleaning of the saw teeth is performed by the cleaning member, so as to control the saw-tooth current corresponding to the print cumulative count and a status of the saw teeth.

Note that, the present invention may be configured to stop increase in the saw-tooth current when exceeding a value of a saw-tooth (needle electrode) life count value, for example. Moreover, for the timing of automatic cleaning by the cleaning member, a control system may be used for the timing to decrease the saw-tooth current by defining a counter.

Further, in the present invention, the charging portion is preferably comprised of an electrode holding member that holds the needle electrode, the electrode holding member includes a base portion having a base face for holding the saw teeth so that the saw teeth are provided approximately vertical to the photoreceptor; and a holding portion for holding the saw teeth approximately parallel along an array direction of the plurality of the saw teeth.

Additionally, in the present invention, a current value that is applied to the saw teeth is preferably obtained based on the amount of the current required for charging to the surface of the photoreceptor for allowing stabilization of image quality corresponding to each cumulative value of the number of printed paper, and a correction coefficient (for example, coefficient of the amount of the saw-tooth current) that is associated in advance with each cumulative value of the number of printed paper.

Further, the present invention is a cleaning control method for controlling operation of a cleaning member including a step of cleaning an electrode of a charging portion by the use of the cleaning member in an image forming apparatus provided with the charging portion that imparts predetermined potential to a photoreceptor on which an electrostatic latent image is formed so as the photoreceptor is charged; a control portion that controls the charging portion; and an image forming portion that forms an image based on the electrostatic latent image that is formed on the photoreceptor charged by electrophotography, the cleaning control method including a step of moving the cleaning member while sequentially coming into contact with tip portions of a plurality of saw teeth along an array direction of the saw teeth of the electrode in which the plurality of the saw teeth is arrayed in one direction; a step of increasing a current value which is applied to the saw teeth (saw-tooth current) by increasing a cumulative value of the number of printed paper; and a step of decreasing the current value which is applied to the saw teeth to a predetermined value when cleaning of the saw teeth is performed by the cleaning member.

According to the image forming apparatus of the present invention, in the image forming apparatus provided with a charging portion that imparts predetermined potential to a photoreceptor on which an electrostatic latent image is formed so as the photo receptor is charged; a control portion that controls the charging portion; and an image forming portion that forms an image based on the electrostatic latent image that is formed on the photoreceptor charged by electrophotography, in which the charging portion is comprised of a needle electrode in which a plurality of saw teeth is arrayed in one direction (approximately vertical direction with respect to a moving direction of the photoreceptor); a cleaning member that cleans the needle electrode by moving along an array direction of the plurality of the saw teeth while sequentially contacting with tip portions of the plurality of the saw teeth; a cleaning member supporter that supports the cleaning member; and a moving portion that moves the cleaning member supporter along the array direction of the plurality of the saw teeth, and the control portion includes a function to increase a current value that is applied to the saw teeth (saw-tooth current) by increasing a cumulative value of the number of printed paper (for example, print cumulative count); and a function to decrease the current value that is applied to the saw teeth to a predetermined value when cleaning of the saw teeth is performed by the cleaning member for controlling so as to decrease the saw-tooth current corresponding to the print cumulative count and a status of the saw teeth, so that it is possible to decrease the amount of ozone to be generated from the charging portion to suppress image defects such as image blurring and white spots for allowing a high-definition image to be stably obtained, while making it possible to attempt to give the charging portion a longer life.

Further, according to the present invention, the charging portion is comprised of an electrode holding member that holds the needle electrode, the electrode holding member includes a base portion having a base face for holding the saw teeth so that the saw teeth are provided approximately vertical to the photoreceptor; and a holding portion for holding the saw teeth approximately parallel along an array direction of the plurality of the saw teeth, so that it is possible accurately position and hold the saw teeth with respect to the photoreceptor.

Moreover, according to the present invention, a current value that is applied to the saw teeth is obtained based on the amount of the current required for charging to the surface of the photoreceptor for allowing stabilization of image quality corresponding to each cumulative value of the number of printed paper, and a correction coefficient (for example, coefficient of the amount of the saw-tooth current) that is associated in advance with each cumulative value of the number of printed paper, so that it is possible to easily decide the saw-tooth current.

Additionally, according to the cleaning control method of the present invention, provided is a cleaning control method for controlling operation of a cleaning member including a step of cleaning an electrode of a charging portion by the use of the cleaning member in an image forming apparatus provided with the charging portion that imparts predetermined potential to a photoreceptor on which an electrostatic latent image is formed so as the photoreceptor is charged; a control portion that controls the charging portion; and an image forming portion that forms an image based on the electrostatic latent image that is formed on the photoreceptor charged by electrophotography, including a step of moving the cleaning member while sequentially coming into contact with tip portions of a plurality of saw teeth along an array direction of the saw teeth of the electrode in which the plurality of the saw teeth are arrayed in one direction; a step of increasing a current value which is applied to the saw teeth (saw-tooth current) by increasing a cumulative value of the number of printed paper; and a step of decreasing the current value which is applied to the saw teeth to a predetermined value when cleaning of the saw teeth is performed by the cleaning member, so that it is possible to decrease the amount of ozone to be generated from the charging portion to suppress image defects such as image blurring and white spots for allowing a high-definition image to be stably obtained, while making it possible to attempt to give the charging portion a longer life.

DESCRIPTION OF THE PREFERRED EMBODIMENTS

Description will be hereinafter given for embodiments of an image forming apparatus of the present invention with reference to drawings.

Figure 1:
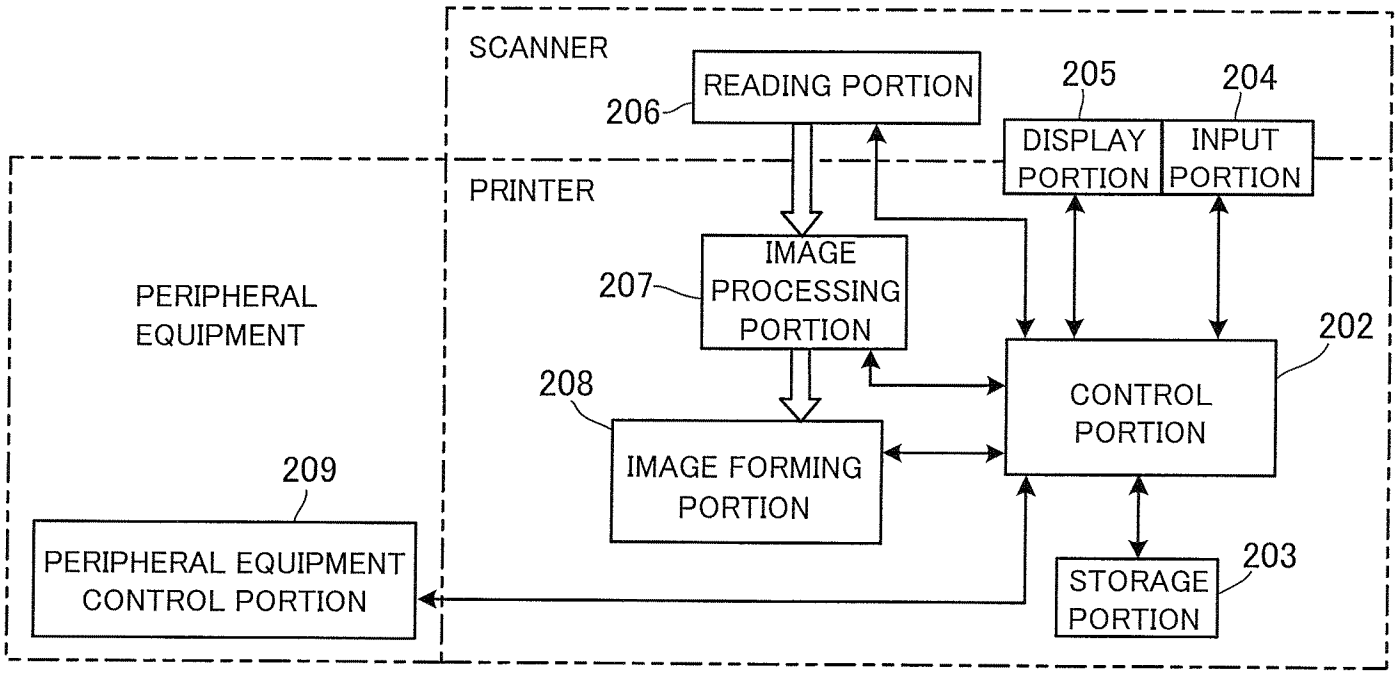
FIG. 1 is a block diagram showing a configuration of an image forming apparatus according to an embodiment of the present invention.
Figure 2:
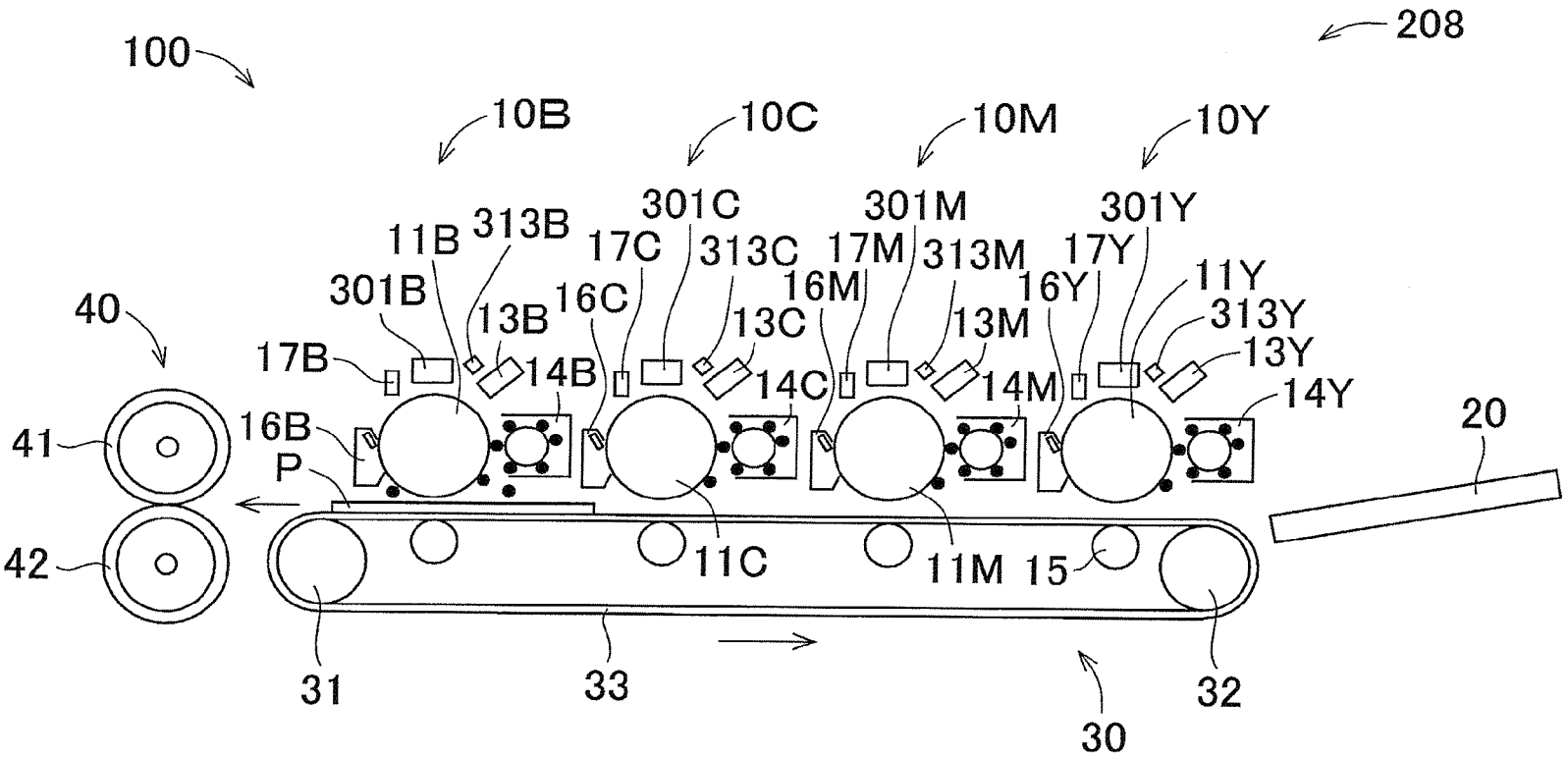
FIG. 2 is an illustrative view schematically showing an example of a specific configuration of an image forming portion in the image forming apparatus.

FIG. 1 is a block diagram showing a configuration of an image forming apparatus according to an embodiment of the present invention, and FIG. 2 is an illustrative view schematically showing an example of a specific configuration of an image forming portion in the image forming apparatus.

An image forming apparatus 100 of the present embodiment employs, as shown in FIG. 1 and FIG. 2, configurations of a charging portion and a control portion of the image forming apparatus according to the present invention as configurations of a charging device 301 and a control portion 202 in an image forming apparatus provided with the charging device (charging portion) 301 that imparts predetermined potential to a photoreceptor 11 on which an electrostatic latent image is formed so as the photoreceptor 11 is charged; the control portion 202 including a function to control the charging device 301; and an image forming portion 208 that forms an image based on the electrostatic latent image formed on the photoreceptor charged by electrophotography.

First, description will be given for an entire configuration of the image forming apparatus 100 according to the present embodiment.

The image forming apparatus 100 is a multi-functional peripheral provided with, for example, a scanner, a printer and peripheral equipment, and as shown in FIG. 1, includes a reading portion 206, an image processing portion 207, the image forming portion 208, a peripheral equipment control portion 209, an operation portion, a storage portion 203 and the control portion 202.

The reading portion 206 reads a document image, and converts the read document image into a proper electric signal at the image processing portion 207 to generate image data. The image forming portion 208 prints out the generated image data. Description will be given in detail below for the image forming portion 208.

The peripheral equipment control portion 209 controls peripheral equipment such as a finisher and a sorter as post-processing devices. The operation portion is provided with an input portion 204 and a display portion 205.

In the image forming apparatus 100, cleaning control in the charging device 301 is performed, while in the storage portion 203, for example, data of a correction coefficient of the saw-tooth current that is used for cleaning control, data of print cumulative count, data of a saw-tooth life counter, and data of a saw-tooth cleaning counter are stored.

The control portion 202 performs the cleaning control.

Description will be given in detail below for cleaning control and control of a saw-tooth current using data of a correction coefficient that is stored in the storage portion 203 which is performed by the control portion 202.

Next, description will be given for a specific configuration and operation of the image forming portion 208.

The image forming apparatus 100 of the present embodiment is a full-color image forming apparatus by electrophotography, and forms a multicolor or unicolor image on a recording medium (transfer medium) based on, for example, image data that is transmitted from the outside via a network or image data read by the reading portion 206.

As shown in FIG. 2, the image forming apparatus 100 is provided with a visible image formation unit 10, a supply tray 20, a recording medium conveyance portion 30, and a fixing device 40. Here, an image that is developed at the visible image formation unit 10 (toner image) is brought into direct transfer to a recording medium P, however, may be transferred to an intermediate transfer medium of an intermediate transfer belt or the like.

In the visible image formation unit 10, four visible image formation units 10Y, 10M, 10C and 10B are arranged side by side corresponding to respective colors of yellow (Y), magenta (M), cyan (C) and black (B). That is, the visible image formation unit 10 is comprised of four visible image formation units 10Y, 10M, 10C and 10B, in which the visible image formation unit 10Y uses a toner of yellow (Y) to perform image formation, the visible image formation unit 10M uses a toner of magenta (M) to perform image formation, the visible image formation unit 10C uses a toner of cyan (C) to perform image formation, and the visible image formation unit 10B uses a toner of black (B) to perform image formation.

As specific arrangement, four sets of the visible image formation units 10Y, 10M, 100 and 10B are disposed along a conveyance path for conveying the recording medium P from the supply tray 20 to the fixing device 40, and the recording medium P to be conveyed is subjected to multi layer transfer of a toner in each color. As shown in FIG. 2, each of the visible image formation units 10Y, 10M, 100 and 10B has substantially the same configuration. That is, each of the visible image formation units is provided with the photoreceptor (photoreceptor drum, image carrier) 11, the charging device 301, a temperature and humidity sensor 313, a laser beam irradiation portion 13, a developing device 14, a transfer roller 15, a cleaner unit 16 and a charge erasing device 17. The photoreceptor 11, the laser beam irradiation portion 13 and the developing device 14 correspond to the image forming portion 208.

Here, description will be given in detail for a configuration of the visible image formation unit 10 constituting the image forming portion 208.

Figure 3:
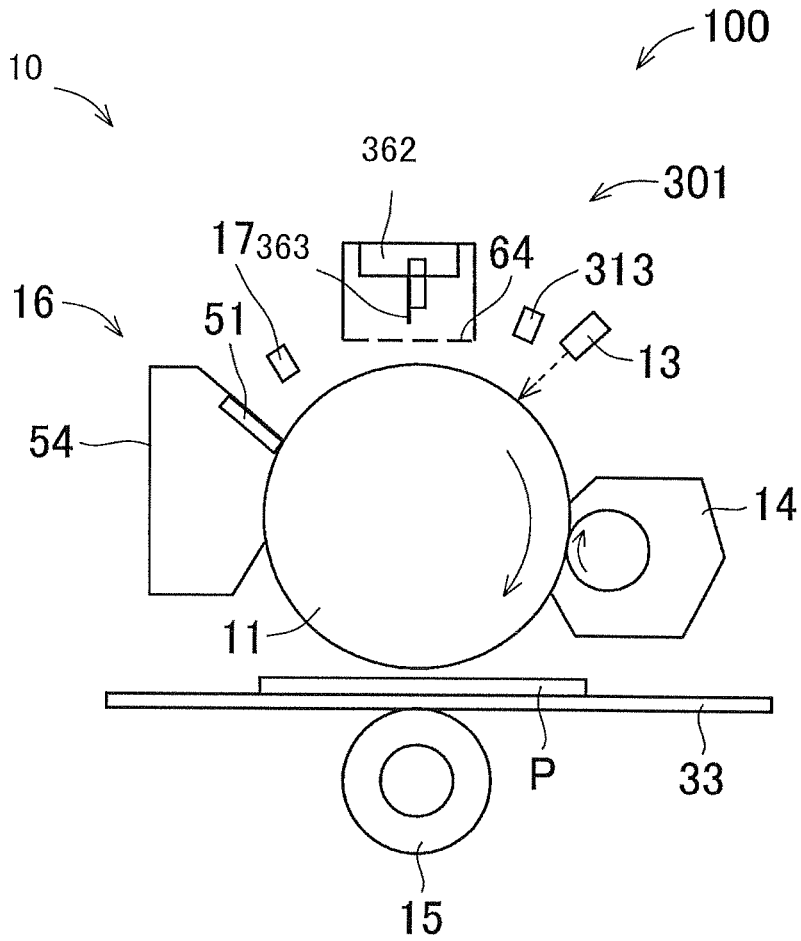
FIG. 3 is an illustrative view showing an example of a structure of the periphery of a photoreceptor constituting a visible image formation unit of the image forming apparatus.

FIG. 3 is an illustrative view showing an example of a structure of the periphery of a photoreceptor constituting a visible image formation unit of the present embodiment.

In the visible image formation unit 10 constituting the image forming portion 208, as shown in FIG. 3, the charging device 301, the laser beam irradiation portion 13, the developing device 14, the transfer roller 15, the cleaner unit 16, and the charge erasing device 17 are arranged in this order along a rotational direction of the photoreceptor 11, that is, toward a downstream side from an upstream side of the rotational direction so as to face the surface of the photoreceptor 11 as an image carrier.

The charging device 301 as a charging portion is a device for uniformly charging the surface of the photoreceptor 11 to predetermined potential, and for which a corona charging type charging device by a noncontact charging system, that is brought into close contact with the surface of the photoreceptor 11 in noncontact to be charged by corona discharge and grid bias control is used.

The laser beam irradiation portion 13 is a device for exposing the surface of the photoreceptor 11 that is charged by the charging device 301 corresponding to image data to form an electrostatic latent image on the surface of the photoreceptor 11.

The developing device 14 is a device for supplying a toner to the electrostatic latent image that is formed on the surface of the photoreceptor 11 to be developed for forming a toner image as a visible image. At the time of supplying a toner to the surface of the photoreceptor 11, potential of a polarity opposite to charging potential of the toner is applied to the developing device 14 as developing bias voltage. Thereby, the toner is smoothly supplied to the electrostatic latent image.

The transfer roller 15 is a device for transferring a toner image to which bias voltage of a polarity opposite to that of the toner is applied and which is formed on the photoreceptor 11 to the recording medium P that is conveyed by a conveyance belt 33.

The cleaner unit 16 removes and collects a toner that remains on the surface of the photoreceptor 11 after transfer processing by the transfer roller 15. The cleaner unit 16 is provided with a case 54 and a cleaning blade 51. The cleaning blade 51 is provided for collecting a toner that remains on the surface of the photoreceptor 11, and formed of a long rubber member regarding an axial direction of the photoreceptor 11 as a longitudinal direction.

The charge erasing device 17 is a device for erasing a charge on the surface of the photoreceptor 11.

In each visible image formation unit configured as described above, the photoreceptor 11 has a charge erased by the charge erasing device 17, and the surface then charged by the charging device 301, followed by exposure of the charged surface of the photoreceptor 11 by the laser beam irradiation portion 13 to form an electrostatic latent image, then developing the electrostatic latent image by the developing device 14 for transferring the developed toner image to the recording medium P by the transfer roller 15. A toner image that remains on the surface of the photoreceptor 11 after transfer is removed and collected by the cleaner unit 16. Then, such transfer of a toner image onto the recording medium P is sequentially performed in the visible image formation unit in each color, so that the recording medium P is subjected to multi layer transfer of a toner image in each color.

Returning to FIG. 2, the recording medium conveyance portion 30 includes a driving roller 31, an idling roller 32 and the conveyance belt 33 for transferring a recording medium so as to transfer a toner image onto the recording medium P by each visible image formation unit. The driving roller 31 and the idling roller 32 are provided for stretching out an endless conveyance belt 33 therebetween, and the driving roller is rotationally driven at a predetermined circumferential speed, whereby the conveyance belt 33 rotates. Further, the conveyance belt 33 has an outer surface that is charged to predetermined potential, and statically adsorbs and conveys the recording medium P.

The recording medium that is conveyed by the recording medium conveyance portion 30 for passing through each visible image formation unit, onto which a toner image (unfixed toner image) is transferred is peeled off from the conveyance belt 33 at curvature of the driving roller 31 to be conveyed to the fixing device 40.

The fixing device 40 imparts moderate heat and pressure to the recording medium, and dissolves a toner that is transferred onto the recording medium P to be fixed to the recording medium, then discharging the recording medium to a paper output tray (not shown). The fixing device 40 has a configuration which is not particularly limited, and for which, a configuration in which, for example, a heating roller 41 and a pressing roller 42 are provided for holding and conveying the recording medium by both of these rollers is usable. Such operation allows an image to be formed on the recording medium P.

Such operation of each member described above that is provided in the image forming apparatus 100 is controlled by the control portion (not-shown control integrated circuit board or not-shown computer) 202.

Next, description will be given in detail for a configuration of a characteristic charging device 301 of the present embodiment with reference to drawings.

Figure 4:
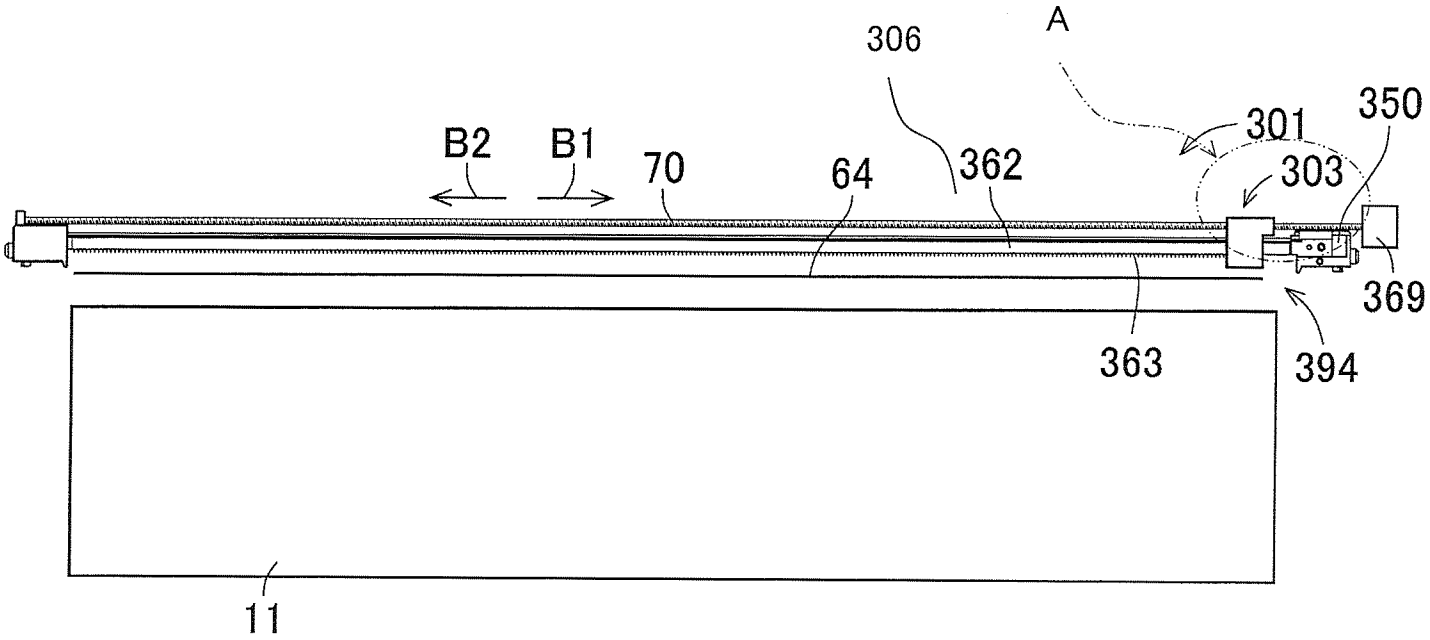
FIG. 4 is a side view schematically showing a configuration of a charging device of the present embodiment.
Figure 5:
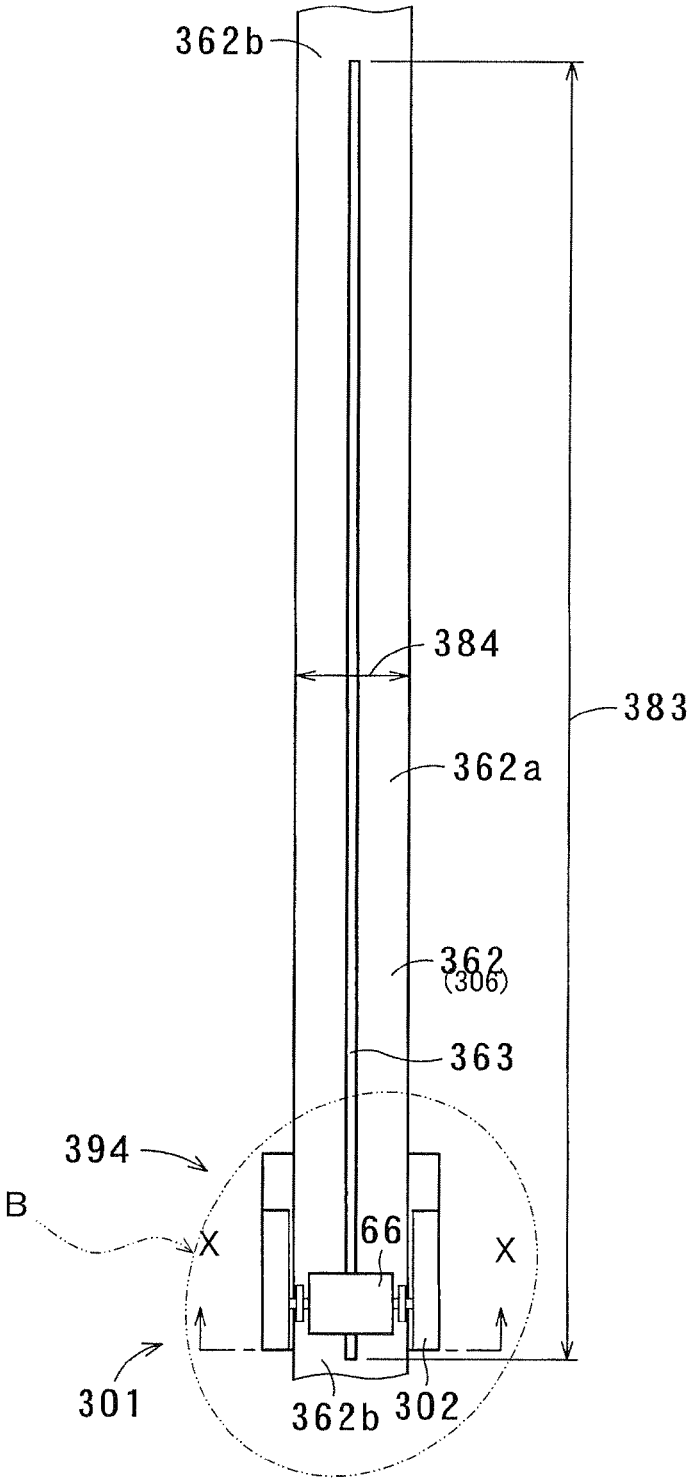
FIG. 5 is an illustrative view viewed from a bottom side schematically showing the configuration of the charging device.
Figure 6:
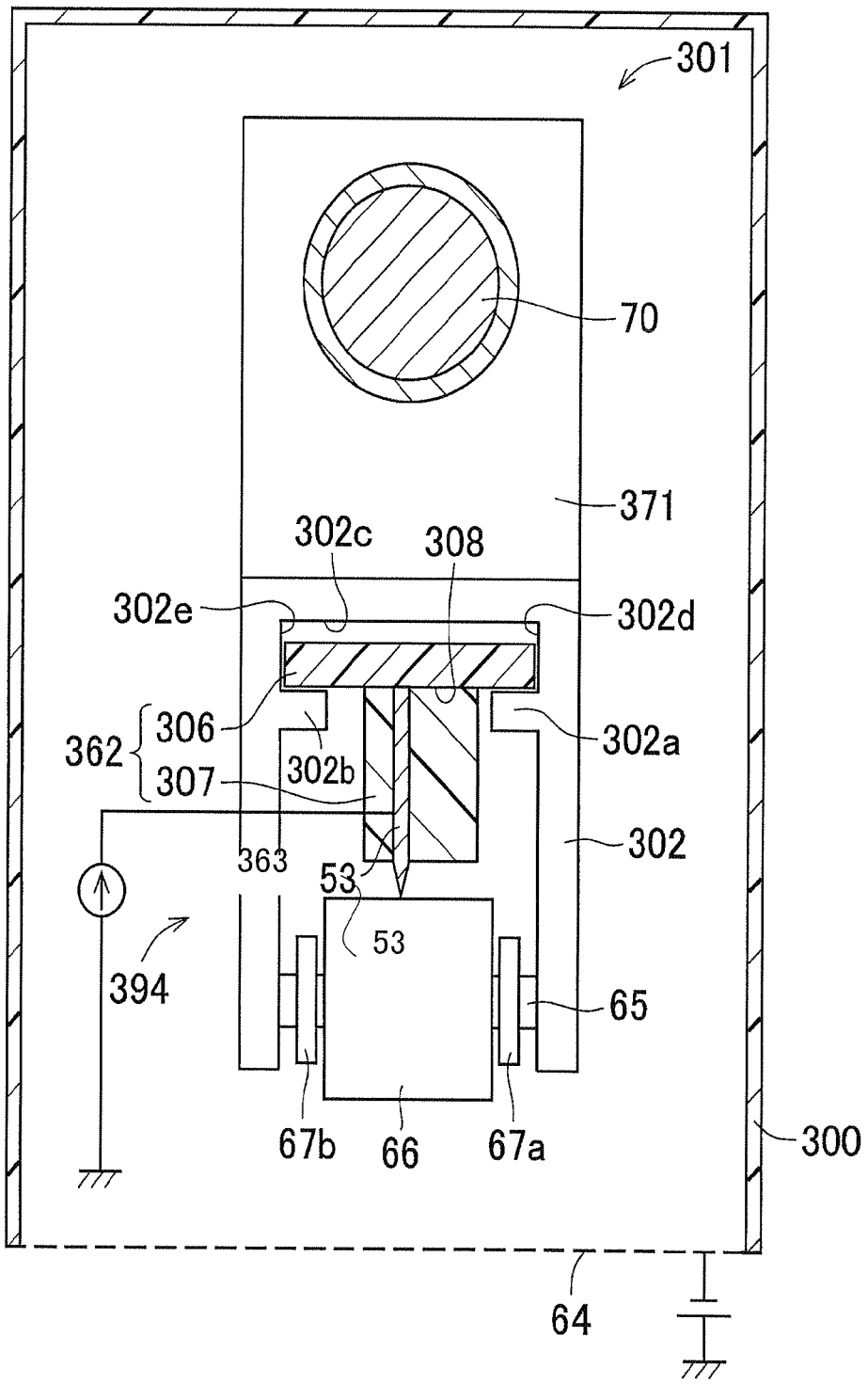
FIG. 6 is a cross-sectional view taken along an arrow X-X in FIG. 5.
Figure 7:
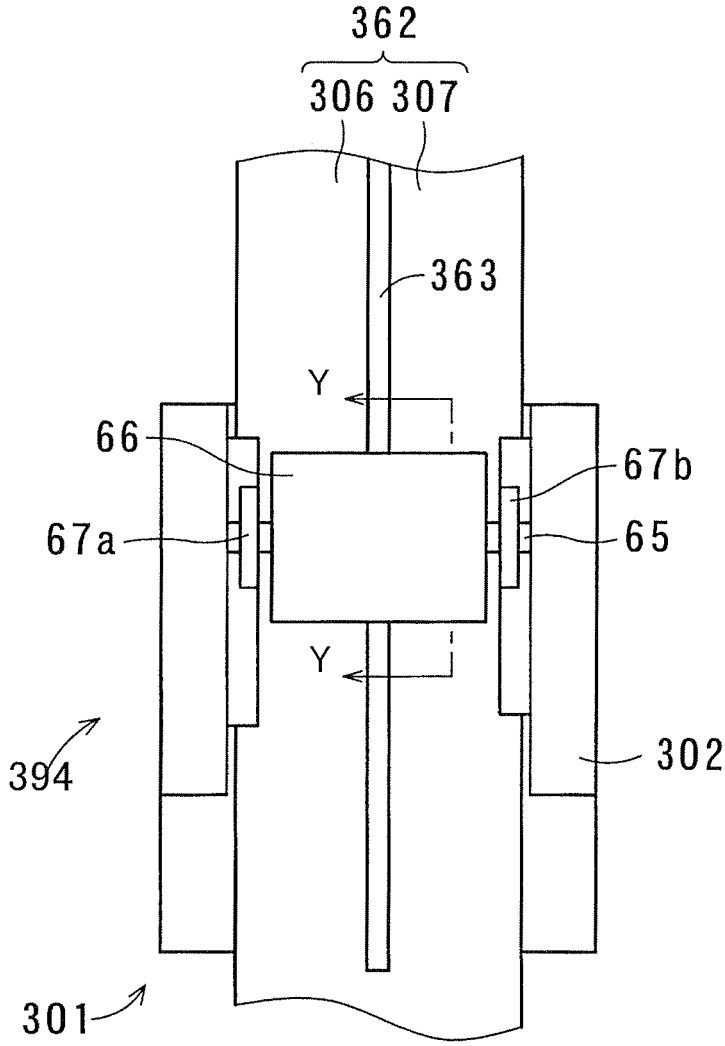
FIG. 7 is an enlarged view of a B-part showing the periphery of a cleaning rubber roller constituting the charging device of FIG. 5.
Figure 8:
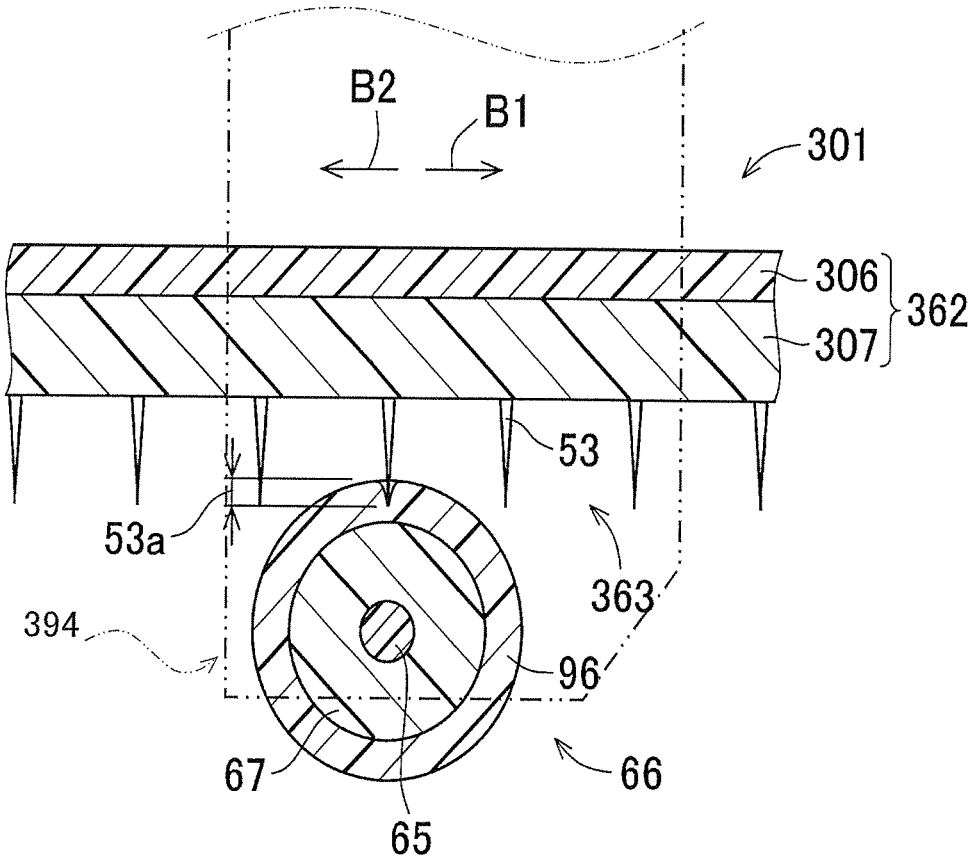
FIG. 8 is a cross-sectional view taken along an arrow Y-Y in FIG. 7.
Figure 9:
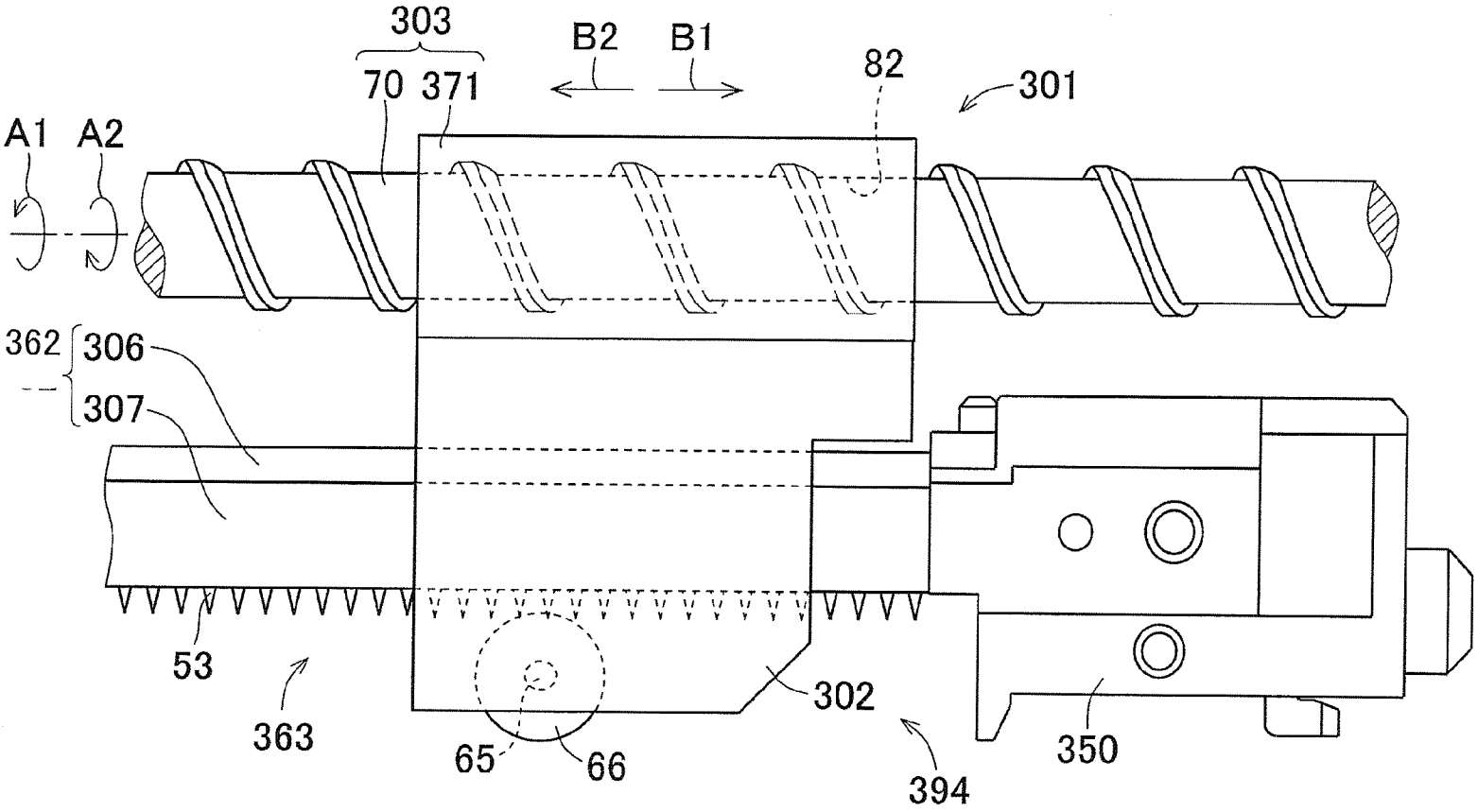
FIG. 9 is an enlarged view of an A-part showing the periphery of a cleaning member supporter constituting the charging device of FIG. 4.

FIG. 4 is a side view schematically showing a configuration of a charging device of the present embodiment; FIG. 5 is an illustrative view viewed from a bottom side schematically showing the configuration of the charging device; FIG. 6 is a cross-sectional view taken along an arrow X-X in FIG. 5; FIG. 7 is an enlarged view of a B-part showing the periphery of a cleaning rubber roller constituting the charging device of FIG. 5; FIG. 8 is a cross-sectional view taken along an arrow Y-Y in FIG. 7; and FIG. 9 is an enlarged view of an A-part showing the periphery of a cleaning member supporter constituting the charging device of FIG. 4.

Hereinafter, description will be given for an example of a configuration of the charging device 301 which is able to be used in the image forming portion 208 of the image forming apparatus 100 of the present embodiment.

The charging device 301 is surrounded by a charging case 300 as shown in FIG. 6.

The charging device 301 includes, as shown in FIG. 4, FIG. 5 and FIG. 6, the charging case 300, a needle electrode 363, a saw-tooth holding member 362, a cleaning rubber roller (cleaning member) 66, a cleaning member supporter 394, a moving portion 303, a screen grid 64, and a terminal portion 350.

The needle electrode 363 is made of a thin belt-like metallic material, and as shown in FIG. 4 and FIG. 6, a plurality of saw teeth 53 protrudes downward in certain intervals over the entire length thereof. The plurality of the saw teeth 53 is arrayed in one direction along arrows B1 and B2 parallel to a length direction of the needle electrode 363. The surface of the photoreceptor 11 is charged to uniform potential by discharge from the needle electrode 363. The plurality of the saw teeth 53 is arrayed over a longitudinal direction of the photoreceptor 11, and there is a certain distance between tip portions of the saw teeth 53 and the photoreceptor 11. The length of the needle electrode 363 is longer than the length in an axial direction of a peripheral surface in the photoreceptor 11. Constant current power supply is connected to the saw teeth 53. Constant voltage power supply is connected to the screen grid 64.

The saw-tooth holding member 362 holding the plurality of the saw teeth 53 holds the needle electrode 363 with a base part 306 having a base face 308 vertically holding the saw teeth 53 with respect to the saw teeth 53, and a holding part 307 holding the saw teeth 53 parallel to the saw teeth 53, as shown in FIG. 6.

The length of the saw-tooth holding member 362 is formed longer than the length of the needle electrode 363.

The base part 306 has, as shown in FIG. 4 and FIG. 5, a nonexistence portion 362*b* integrally formed in which the saw teeth 53 do not exist at both edge portions of an existence portion 362*a* in which the saw teeth 53 exist.

In the present embodiment, the length in a longitudinal direction 383 is 342 mm, and the length in a short direction 384 is 20 mm in the existence portion 362*a*. The saw-tooth holding member 362 is fixed to the charging case 300 of the charging device 301 at the both edge portions of the longitudinal direction. The saw-tooth holding member 362 is made of an insulating material such as a synthetic resin.

The cleaning rubber roller 66 as a cleaning member is, as shown in FIG. 5, FIG. 6 and FIG. 7, arranged in a position facing the needle electrode 363, and in an outer periphery of a shaft 65, formed between two rotating rollers (first rotating roller 67*a*, second rotating roller 67*b*). The cleaning rubber roller 66 is arranged so as to move along an array direction of the saw teeth 53 between tip portions of the saw teeth 53 and the photoreceptor 11, and at the time of moving, an outer peripheral surface thereof sequentially comes into contact with the tip portions of a plurality of the saw teeth 53, thereby cleaning the needle electrode 363.

The cleaning rubber roller 66 is, as shown in FIG. 8, a roll member with a three-layer structure in which a columnar shaft 65, a cylindrical core metal 67, and an elastic layer 96 are formed in this order from the inside thereof.

Materials of the shaft 65 include materials made of polycarbonate and SUS (Stainless Steel). Materials of the core metal 67 include materials made of polycarbonate and SUS. Materials of the elastic layer 96 include EPDM (ethylene propylene dien rubber). A diameter of the cleaning rubber roller 66 is allowed to be enlarged as much as possible in a range not coming into contact with a peripheral surface of the screen grid 64, for example, having the diameter of 6 mm and the length in an axial direction of 4 mm.

In the present embodiment, the cleaning rubber roller 66 is constituted by using the shaft 65 composed of a material made of polycarbonate having an external diameter of 2 mm, using the core metal 67 composed of a material made of polycarbonate having the thickness of 1.5 mm and the length in the axial direction of 4 mm, and using the elastic layer 96 composed of a material made of ethylene propylene dien rubber. Note that, both the shaft 65 and the core metal 67 maybe integrally formed of a material made of polycarbonate.

In the needle electrode 363, as shown in FIG. 8, tip portions of the saw teeth 53 sequentially come into contact with the cleaning rubber roller 66 so as to be embedded, so that a floating toner, volatized TMS and dust attached to the tip portions of the saw teeth 53 are cleaned by action for collecting dust of electrostatic force along with corona discharge.

The cleaning rubber roller 66 moves along the arrows B1 and B2 while rotating by resistance acting on the peripheral surface from the plurality of the saw teeth 53. The cleaning member supporter 394 holds, as shown in FIG. 8, the cleaning rubber roller 66 so that length 53*a* becomes about 0.5 mm, that is, so that the length of about 0.5 mm of each tip portion of the saw teeth 53 is embedded in a peripheral surface of the cleaning rubber roller 66.

Returning to FIGS. 4, 5 and 6, the cleaning member supporter 394 includes a rubber roller supporter 302, the shaft 65, two rotating rollers 67*a* and 67*b*, and protruding pieces 302*a* and 302*b*. Additionally, the cleaning member supporter 394 has both edge portions of the shaft 65 fixed in the rubber roller supporter 302 so as to rotate freely, thereby supporting the cleaning rubber roller 66 so as to revolve freely.

The protruding pieces 302*a* and 302*b* protrude to and formed on an inner surface side of the cleaning member supporter 394 as shown in FIG. 6. The cleaning member supporter 394 holds the saw-tooth holding member 362 in a vertical direction with an upper surface 302*c*, and the protruding pieces 302*a* and 302*b* on the inner surface, and holds the saw-tooth holding member 362 in a horizontal direction with side surfaces 302*d* and 302*e* on the inner surface. Thereby, moving including rotation of the cleaning member supporter 394 is regulated in a direction parallel to the base face 308 and orthogonal to the arrows B1 and B2. After cleaning of the needle electrode 363, the cleaning member supporter 394 is moved by the moving portion to a position not preventing printing where there are no saw teeth 53, that is, to either one of two nonexistence portions 362*b* shown in FIG. 5.

The moving portion 303 includes a screw 70 and a moving member 371 as shown in FIG. 9. The moving member 371 has a threaded screw hole 82 penetrating therethrough which is threadably mounted from the screw 70 as a threaded shaft.

The screw 70 is provided over a longitudinal direction of the base part 306 as shown in FIG. 4, and the rotation causes the cleaning member supporter 394 to move along the screw 70. The screw 70 rotates by a motor 369. The motor 369 is able to reversely rotate. As shown in FIG. 9, when the screw 70 rotates in an arrow A1 direction, the rotation causes the cleaning member supporter 394 to move in an arrow B1 direction, and when the screw 70 rotates in an arrow A2 direction, the rotation causes the cleaning member supporter 394 to move in an arrow B2 direction. The screw 70 is configured parallel to an array direction of the saw teeth 53 and an axial direction of the photoreceptor 11.

The terminal portion 350 houses a not-shown terminal as shown in FIG. 9. The terminal connects high-voltage power supply to the needle electrode 363. When the high-voltage power supply is applied to the needle electrode 363 via the terminal, an applied field is concentrated in the tip portions of the saw teeth 53 so that this part is easily discharged. Thereby, the surface of the photoreceptor 11 is discharged from the plurality of the saw teeth 53 so that such discharge causes the surface of the photoreceptor 11 to be charged to predetermined potential.

The charging device 301 configured as described above is configured to control operation by the control portion 202.

In the present embodiment, the control portion 202 includes a function to increase a current value applied to the saw teeth (saw-tooth current) by increasing the number of printed paper cumulated (hereinafter, referred to as "print cumulative count"); and a function to decrease the current value applied to the saw teeth 53 to a predetermined value when the cleaning roller 66 is operated. That is, the control'portion 202 is configured to control the saw-tooth current corresponding to the print cumulative count and a state of the saw teeth 53 in addition to normal motion control of each component of the image forming apparatus 100.

Next, description will be given for cleaning control including characteristic motion control of the cleaning rubber roller 66 and control of a saw-tooth current value by the control portion 202 controlling operation of the charging device 301 of the present embodiment.

Figure 10:
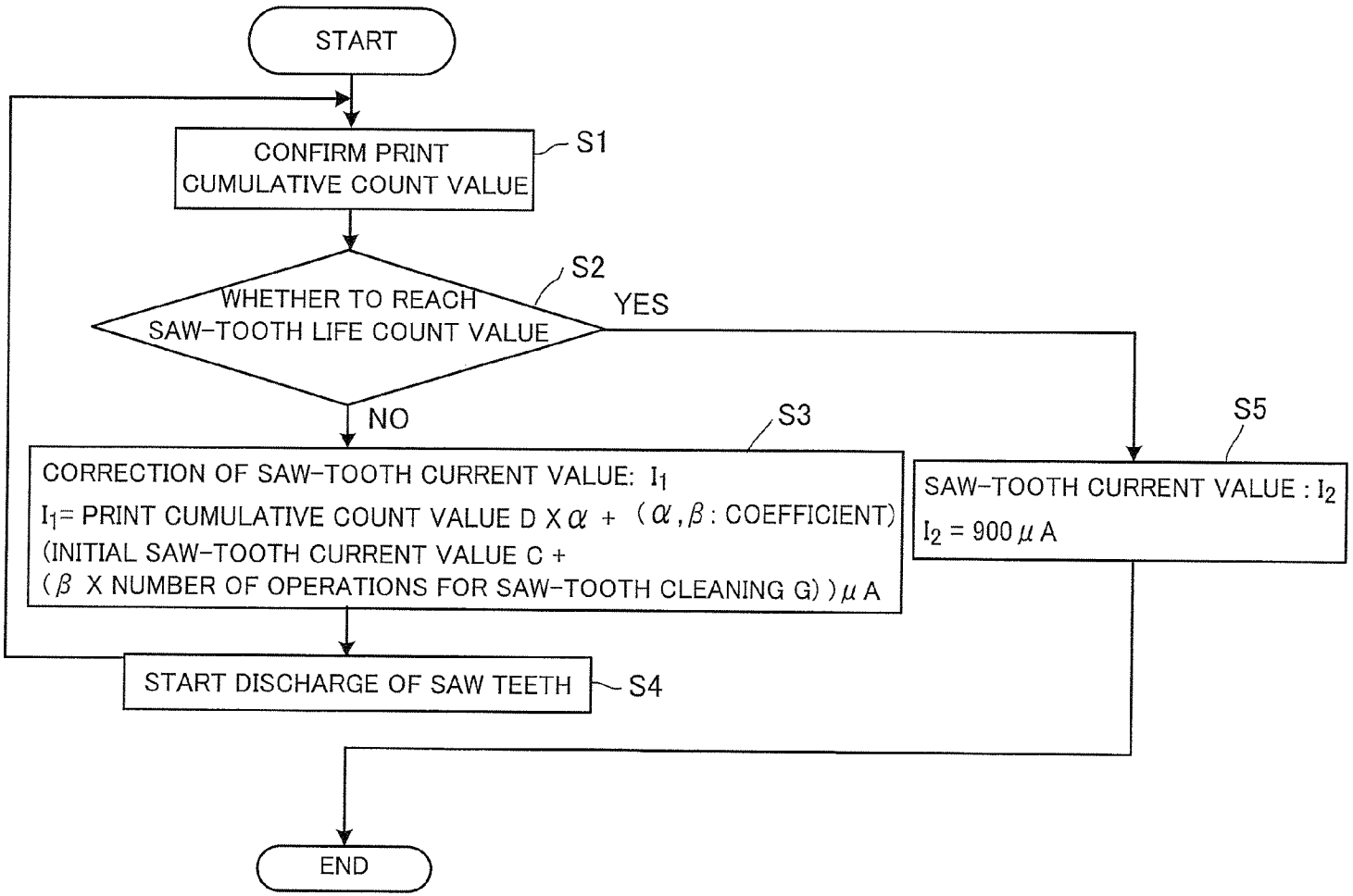
FIG. 10 is a flowchart showing control of a saw-tooth current value based on print cumulative count in the charging device.
Figure 11:
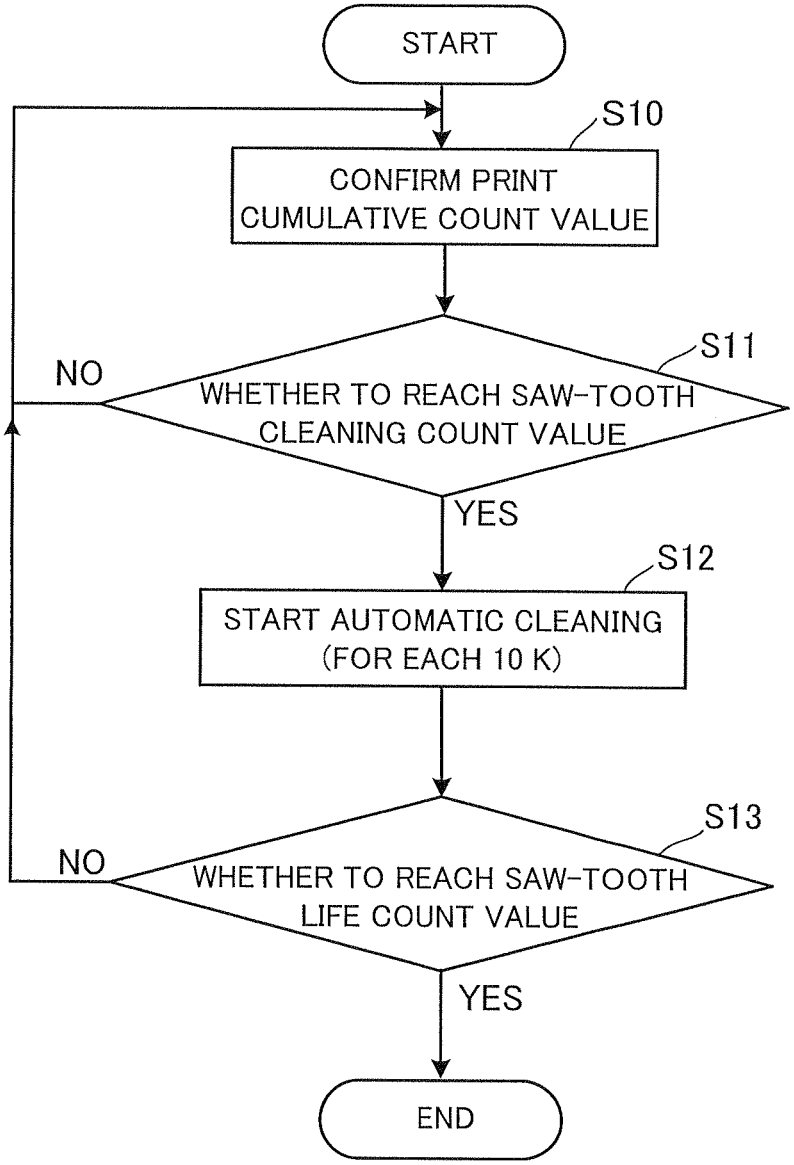
FIG. 11 is a flowchart showing automatic cleaning control with a cleaning member based on the print cumulative count in the charging device.

FIG. 10 is a flowchart showing control of a saw-tooth current value based on print cumulative count in the charging device of the present embodiment, and FIG. 11 is a flowchart showing automatic cleaning control with a cleaning member based on the print cumulative count in the charging device.

First, description will be given based on a flowchart for control of a saw-tooth current value based on the print cumulative count by the control portion 202 in the charging device 301 of the present embodiment.

When a print switch or a copy key in the operation portion of the image forming apparatus 100 body is turned on, image information of one job is transmitted to the control portion 202 to start printing at the image forming portion 208. Then, when one page of the job is printed, control of a saw-tooth current value based on the print cumulative count according to the present invention is started.

As shown in FIG. 10, when the print cumulative count is confirmed by the control portion 202 in the image forming apparatus 100 (step S1), determination is made whether or not the print cumulative count value reaches saw-tooth life count value (200 K sheets (1 K=1000)) (step S2).

Here, description will be given for calculation of the print cumulative count value as a cumulative value of the number of printed sheets.

A print cumulative count value D is calculated by summing a print completion cumulative count value d that is stored in advance in the storage portion 203 and a count value for each print c, and represented by the following formula (1).

$$\text{Print cumulative count value: } D=(\text{Print completion cumulative count value d})+(\text{Count value for each print c}) \quad (1)$$

The print completion cumulative count value d is a cumulative count value of pages for which printing has been completed prior to pages for which printing has been performed at the last minute.

Further, the print completion cumulative count value d is represented by the following formula (2) , where the sum of each count value for each job in which printing has been completed is X1, X2 . . . , and each count value for each print of pages prior to pages for which printing has been performed at the last minute is Y1, Y2 in a job in which printing is currently being performed.

$$\text{Print completion cumulative count value: } d=(X1+X2+\ldots)+(Y1+Y2+\ldots) \quad (2)$$

At step S2, in a case where determination is made that the print cumulative count value does not reach the saw-tooth life count value (200 K), the process goes to step S3.

At step S3, a saw-tooth current value $I_1$ is corrected based on the size of the printed recording medium and number of times in which saw teeth has been cleaned.

A saw-tooth current coefficient α is voluntarily settable for each image forming apparatus, and stored in the storage portion 203 in advance.

The saw-tooth current value $I_1$ is calculated by the print cumulative count value D and number of operations for saw-tooth cleaning G. The saw-tooth current value $I_1$ is a primary expression of the print cumulative count value D that is stored in the storage portion 203. A slope as a coefficient a corresponding to each image forming apparatus, and intercept as (initial saw-tooth current value C+(βX number of operations for saw-tooth cleaning G)) are stored in the storage portion 203 in advance.

The initial saw-tooth current value C and the coefficient β are decided corresponding to each image forming apparatus.

Then, discharge for the photoreceptor 11 is started with the corrected saw-tooth current value $I_1$ (step S4). The process then returns to step S1.

On the other hand, at step S2, when determination is made that the print cumulative count reaches the saw-tooth life count (200 K), the process goes to step S5 to provide a saw-tooth current value $I_2$ as 900 μA, and control of the current value is finished.

Note that, the flowchart is an example of control of a saw-tooth current value based on the print cumulative count, and a saw-tooth current value and print cumulative count of the saw teeth 53 at the end of their life, a print cumulative count value for executing cleaning, and number of executions for cleaning (reciprocating cycle of the cleaning roller) are voluntarily settable for each image forming apparatus.

EXAMPLE 1

Example 1 shows a saw-tooth current value when the initial saw-tooth current value C is regarded as 600 μA, and the coefficient β is regarded as −80.

The saw-tooth current value $I_1$ is represented by the following formula (3).

$$\text{Saw-tooth current value: } I_1=(\text{Print cumulative count value } D)X\alpha+(600+(-80\ X\ \text{Number of operations for saw-tooth cleaning } G))\mu A \quad (3)$$

Next, description will be given based on a flowchart for motion control of the cleaning rubber roller 66 based on the print cumulative count by the control portion 202 in the charging device 301 of the present embodiment.

When motion control of the cleaning rubber roller 66 based on the print cumulative count according to the present invention is started, as shown in FIG. 11, print cumulative count value is confirmed by the control portion 202 in the image forming apparatus 100 (step S10), and determination is made whether or not the print cumulative count value reaches a saw-tooth cleaning count value (step S11).

When determination is made that the print cumulative count value does not reach the saw-tooth cleaning count value at step S11, the process returns to step S10.

On the other hand, when determination is made that the print cumulative count value reaches the saw-tooth cleaning count value at step S11, the process goes to step S12.

At step S12, printing is stopped once, and automatic cleaning is performed once for reciprocating and moving the cleaning member supporter 394 to perform cleaning of the saw teeth 53. Such automatic cleaning is performed each time the print cumulative count exceeds 10 K.

Then, the process goes to step S13, and the determination is made whether or not the print cumulative count value reaches the saw-tooth life count value (200 K sheets (1 K=1000)).

In a case where determination is made that the print cumulative count value does not reach the saw-tooth life count value at step S13, the process returns to step S10.

On the other hand, in a case where determination is made that the print cumulative count value reaches the saw-tooth life count value at step S13, the cleaning control is finished.

As described above, the control portion 202 causes the saw-tooth current value $I_1$ to increase based on the print cumulative count for controlling operation of the cleaning member supporter 394 corresponding to the print cumulative count, so that it is possible to perform cleaning of the saw teeth 53 by the cleaning rubber roller 66 at optimal timing.

Further, the saw-tooth current is decreased to a predetermined value when cleaning is performed, so that it is possible to decrease the amount of ozone to be generated by charging processing to stably obtain a high-definition image over a long period.

Additionally, it is possible to perform cleaning of the saw teeth 53 before being damaged due to attachment of contaminants, as well as preventing excessive cleaning to suppress deterioration of the saw teeth 53, thus making it possible to attempting to give the saw teeth 53 a further longer life.

Next, description will be given for characteristic cleaning control program and recording medium which are used in the image forming apparatus 100 of the present embodiment.

The control portion 202 of the image forming apparatus 100 according to the present embodiment may be configured by hardware logic, or may be realized with software using a CPU as follows.

In a case where the control portion 202 is realized with software using a CPU, the control portion 202 is provided with a CPU (Central Processing Unit) for executing an instruction of a control program for realizing each function, a ROM (Read Only Memory) for storing the program, a RAM (Random Access Memory) for developing the above-described program, a storage device (storage medium) such as a memory for storing the program and various data, and the like.

Additionally, an object of the present invention is able to be achieved by supplying to the control portion 202 of the image forming apparatus 100 described above a storage medium in which a program code of a cleaning control program that is software for realizing the above-described function (program in an executable format, intermediate code program, source program) is readably stored by a computer for reading and executing the program code that is stored in the storage medium by the computer (or a CPU or an MPU).

As the storage medium, for example, a tape type such as a magnetic tape and a cassette tape; a disk type including a magnetic disk such as a floppy (registered trademark) disk and a hard disk, and an optical disk such as a CD-ROM, an MO, an MD, a DVD, a CD-R and a Blu-ray (registered trademark) disk; a card type such as an IC card (including a memory card) and an optical card; a semiconductor memory type such as a mask ROM, an EPROM, an EEPROM and a flash ROM; or the like is usable.

Further, the image forming apparatus 100 may be configured so as to be connectable to a communication network to supply the above-described program code via the communication network. The communication network is not particularly limited, and for which, for example, Internet, an intranet, an extranet, a LAN, an ISDN, a VAN, a CATV communication network, a Virtual Private Network, a telephone network, a mobile communication network, a satellite communication network, and the like are usable.

Moreover, a transmission medium constituting the communication network is not particularly limited, and for which, for example, both wired communication by IEEE 1394, an USB, a power-line carrier, a cable TV circuit, a telephone line, an ADSL line, and the like, and wireless communication by infrared rays by IrDA and a remote control, Bluetooth (registered trademark), 802.11 wireless communication, an HDR, a mobile telephone network, a satellite circuit, a digital terrestrial network, and the like are usable. Note that, the present invention is able to be realized also in a form of a computer data signal embedded in a carrier wave, in which the above-described program code is embodied by electronic transmission.

In this manner, the cleaning control program is a program for operating the image forming apparatus 100 of the present invention, in which a computer is caused to function as the control portion 202, thereby correcting a saw-tooth current value based on print cumulative count, and it is possible to easily supply to the control portion 202 a method for controlling movement of the cleaning member supporter 394 corresponding to the print cumulative count, as well as making it possible to provide the above-described cleaning control method as a versatile method.

Because of providing the configuration as described above, according to the present embodiment, in the image forming apparatus 100, the charging device 301 is comprised of the needle electrode 363 in which a plurality of the saw teeth 53 is arrayed in an approximately vertical direction with respect to a moving direction of the photoreceptor 11; the cleaning rubber roller 66 that cleans the needle electrode 363; the cleaning member supporter 394; and the moving portion 303 that moves the cleaning member supporter 394, and the control portion 202 includes a function to increase a saw-tooth current by increasing print cumulative count; and a function to decrease the saw-tooth current value to a predetermined value when cleaning of the saw teeth 53 is performed by the cleaning rubber roller 66 for controlling to decrease the saw-tooth current corresponding to the print cumulative count and a status of the saw teeth 53, so that it is possible to decrease the amount of ozone to be generated from the charging device 301 for suppressing image defects such as image blurring and white spots to stably obtain a high-definition image, while it is possible to attempt to give the needle electrode 363 a longer life.

Note that, the present invention is not limited to the above-described embodiments, and various changes can be made thereto in the scope of the claims. That is, embodiments which can be obtained in combination with technical methods appropriately changed without departing from the spirit of the present invention are also included in a technical scope of the present invention.

What is claimed is:

1. An image forming apparatus, comprising:

a charging portion that imparts predetermined potential to a photoreceptor on which an electrostatic latent image is formed so as the photoreceptor is charged;

a control portion that controls the charging portion; and an image forming portion that forms an image based on the electrostatic latent image that is formed on the photoreceptor charged by electrophotography, wherein the charging portion is provided with a needle electrode in which a plurality of saw teeth is arrayed in one direction; a cleaning member that cleans the needle electrode by moving along an array direction of the plurality of the saw teeth while sequentially contacting with tip portions of the plurality of the saw teeth; a cleaning member supporter that supports the cleaning member; and a moving portion that moves the cleaning member supporter along the array direction of the plurality of the saw teeth, and the control portion includes a function to increase a current value that is applied to the saw teeth by increasing a cumulative value of the number of printed paper; and a function to decrease the current value that is applied to the saw teeth when the cleaning member is operated.

2. The image forming apparatus according to claim 1, wherein the charging portion is provided with an electrode holding member that holds the needle electrode, the electrode holding member includes a base portion having a base face for holding the saw teeth so that the saw teeth are provided approximately vertical to the photoreceptor, and a holding portion for holding the saw teeth approximately parallel along the array direction of the plurality of the saw teeth.

3. The image forming apparatus according to claim 1, wherein the current value that is applied to the saw teeth is obtained based on the amount of the current required for charging to the surface of the photoreceptor for allowing stabilization of image quality corresponding to each cumulative value of the number of printed paper, and a correction coefficient associated in advance with each cumulative value of the number of printed paper.

4. A cleaning control method for controlling operation of a cleaning member including a step of cleaning an electrode of a charging portion by the use of the cleaning member in an image forming apparatus provided with the charging portion that imparts predetermined potential to a photoreceptor on which an electrostatic latent image is formed so as the photoreceptor is charged; a control portion that controls the charging portion; and an image forming portion that forms an image based on the electrostatic latent image that is formed on the photoreceptor charged by electrophotography, the cleaning control method comprising:

a step of moving the cleaning member while sequentially contacting with tip portions of a plurality of saw teeth along an array direction of the saw teeth of the electrode in which the plurality of the saw teeth are arrayed in one direction;

a step of increasing a current value which is applied to the saw teeth by increasing a cumulative value of the number of printed paper; and a step of decreasing the current value which is applied to the saw teeth when the cleaning member is operated.

* * * * *